US005579709A

United States Patent [19]

Itoh

[11] Patent Number: 5,579,709

[45] Date of Patent: Dec. 3, 1996

[54] METHOD OF SEWING TWO STRETCHABLE CLOTHS

[76] Inventor: Mitsuru Itoh, 11 W. 8th St. #3B, New York, N.Y. 10011

[21] Appl. No.: 433,047

[22] Filed: May 3, 1995

[51] Int. Cl.[6] ..... A41H 33/00

[52] U.S. Cl. ..... 112/475.09; 2/275

[58] Field of Search ..... 112/475.01, 475.06, 112/475.09, 475.17, 141, 153, 152, 147, 413, 418, 441, 415; 2/135, 255, 275

[56] References Cited

U.S. PATENT DOCUMENTS

| | | | |
|---|---|---|---|
| 364,586 | 6/1887 | Green | 112/475.09 X |
| 1,952,013 | 3/1934 | Kennedy | 2/275 X |
| 1,977,802 | 10/1934 | Miskend | 112/475.09 X |
| 2,048,343 | 7/1936 | Leibowitz | 2/275 X |
| 2,143,381 | 1/1939 | Lind | 2/275 X |
| 4,324,004 | 4/1982 | Smith et al. | 112/475.09 X |

*Primary Examiner*—Ismael Izaguirre
*Attorney, Agent, or Firm*—Kanesaka & Takeuchi

[57] ABSTRACT

Two cloths stretchable in all the directions can be sewed together beautifully. Each stretchable cloth includes an outer edge, a first sewing line situated away from the outer edge to thereby form a free end between the outer edge and the first sewing line, and a main portion. The cloths are laminated and sewed along the first sewing lines to form an outer stitch. Then, at least one of the two stretchable cloths is turned, so that the free ends of the stretchable cloths are covered by at least one of the main portions. Thereafter, the stretchable cloths are sewed along a second sewing line outside the free ends while the free ends are stretched in a direction away from the second sewing line to thereby form a holding stitch. Accordingly, the two stretchable cloths are sewed beautifully and stretchably.

8 Claims, 2 Drawing Sheets

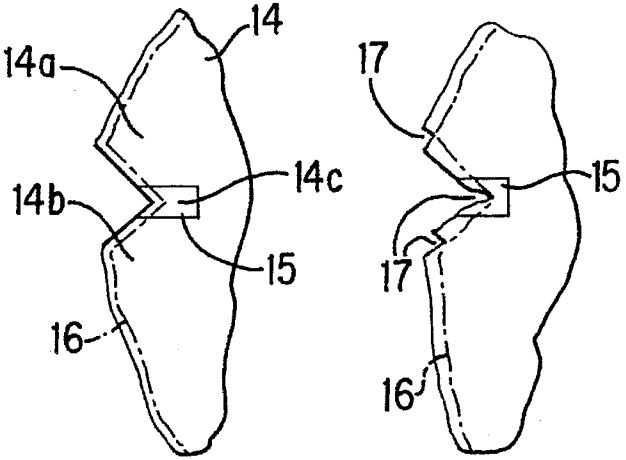
FIG. 3(a)
FIG. 3(b)
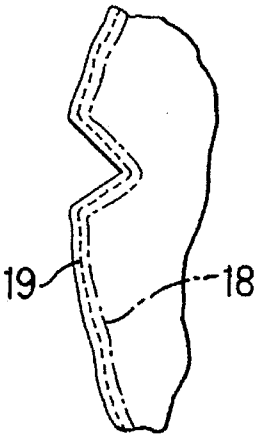
FIG. 3(c)
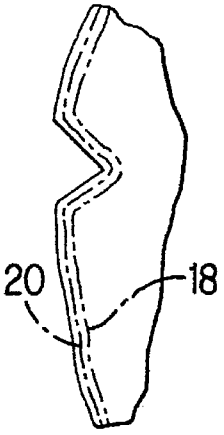
FIG. 3(d)
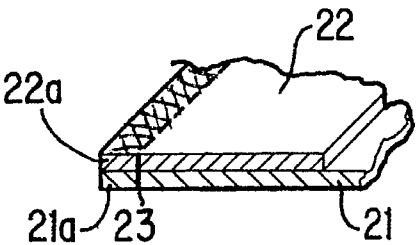
FIG. 4(a)
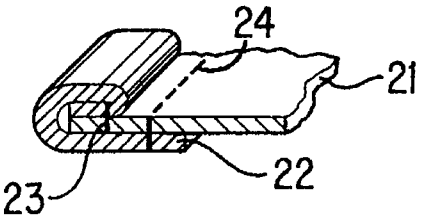
FIG. 4(b)

METHOD OF SEWING TWO STRETCHABLE CLOTHS

BACKGROUND OF THE INVENTION AND RELATED ART STATEMENT

The present invention relates to a method of sewing two cloths stretchable in all directions.

The stretchable cloth formed by stretchable threads, such as LYCRA (trademark by E. I. Du Pont de Nemours and Company), is expandable in all directions like rubber. Therefore, when the stretchable cloths are sewed, it is desirable to be sewed stretchably. However, since the cloths are stretchable, it is difficult to properly stitch the two stretchable cloths together.

Namely, when the stretchable cloths are sewed, the cloths expand laterally while sewing. Thus, the stitch is not formed equally, or the stitch can not be formed beautifully along a desired line. In a general stitching, two stretchable cloths can not be sewed beautifully in a manner accepted as an outer stitching.

In this respect, when the stretchable cloth is sewed, a back tape is applied to a portion of the cloth to be sewed, and the portion with the back tape is sewed. The back tape may be a stretchable rubber tape or the like, which restricts stretchability of the cloth.

When the back tape is used, the stretchable cloth can be sewed properly with the same kind of cloth or other cloth. However, the sewed portion becomes thick, and the stretchability is limited. Therefore, utility of the stretchable cloth is limited, and is not used for a regular garment. Generally, the stretchable cloth is used for swimwear or stockings.

Accordingly, one object of the invention is to provide a method of sewing two stretchable cloths easily and stretchably without using a regular backing tape or a material along a portion to be sewed.

Another object of the invention is to provide a method as stated above, wherein the stretchable cloths can be sewed and assembled while keeping the outer shape properly.

A further object of the invention is to provide a method as stated above, wherein an edge of a stretchable cloth can be covered by another stretchable cloth.

Further objects and advantages of the invention will be apparent from the following description of the invention.

SUMMARY OF THE INVENTION

In accordance with the present invention, two stretchable cloths having stretchability in all directions like rubber can be sewed easily. In the method of the invention, the two stretchable cloths are laminated so that first surfaces of the stretchable cloths orient outwardly while second surfaces of the stretchable cloths face each other. Each stretchable cloth includes an outer edge, a first sewing line and a main portion. The first sewing line is situated away from the outer edge to thereby form a free end between the outer edge and the first sewing line.

The two stretchable cloths laminated together are sewed along the first sewing lines to form an outer stitch, and at least one of the two stretchable cloths is turned. Thus, the first surfaces face each other and the second surfaces orient outwardly. The free ends of the stretchable cloths are retained or covered by at least one of the stretchable cloths.

Thereafter, the two stretchable cloths are sewed along a second sewing line outside the free ends while the free ends are stretched or expanded outwardly in a direction away from the second sewing lines to thereby form a holding stitch. Accordingly, the two stretchable cloths are sewed beautifully and stretchably.

In the invention, it is important that the holding stitch does not sew the free ends covered by one or two main portions, and is located outside the free ends. After forming the holding stitch, however, an additional stitch may be formed to sew the free ends together with the main portions.

It is also important that when the holding stitch is formed, the free ends are stretched or pushed in the direction away from the holding stitch. Namely, the holding stitch is formed under tension. Thus, the holding stitch can be formed along the desired line beautifully.

In the invention, the outer edge of the stretchable cloth may have an edge finish to prevent loosening of the cloth. In this case, the outer stitch is formed after the edge finish. On the other hand, after the two stretchable cloths are laminated, an interlock stitching, which includes the edge finish and outer stitch in one stitching, may be applied for the two stretchable cloths.

In the invention, when the stretchable cloths have projections or dents, the outer stitch is formed along the projections or the dents as usual. However, before turning the stretchable cloth, the free ends near the tips of the projections or the dents are cut. Accordingly, when the stretchable cloth is turned, the free ends at the projections or dents do not partly overlap to thereby reduce the thickness of the free ends.

If it is desired to keep the shape of the projection and the dent, a non-stretchable back patch may be plied over the two stretchable cloths at the projections or the dents. Then, the outer stitch and holding stitch are applied over the back patch to retain the shape of the projection and the dent.

In the invention, one of the stretchable cloths may be an end tape, and the end tape may only be turned to cover the free ends. As a result, the edge of a main stretchable cloth is properly covered by the stretchable end tape.

In the invention, the stretchable cloths can be stitched together while keeping the stretchability at the stitched portion without using a non-stretchable back tape. Thus, the stretchable cloth can be used for a regular garment without limitation.

BRIEF DESCRIPTION OF THE DRAWINGS

FIGS. 3(*a*) to 3(*d*) are explanatory plan views for forming a collar of the garment shown in FIG. 2; and FIGS. 4(*a*) and 4(*b*) are explanatory perspective section views for showing an alternative method for sewing two stretchable cloths of the invention.

DETAILED DESCRIPTION OF PREFERRED EMBODIMENTS

In the invention, stretchable cloths formed by stretchable threads, such as LYCRA (trademark by E. I. Du Pont de Nemours and Company), can be sewed stretchably and beautifully. Although the stretchable cloth is expandable in all the directions like rubber, the cloths can be sewed as desired. Knitted cloths may be sewed in accordance with the present invention.

Figure 1A:
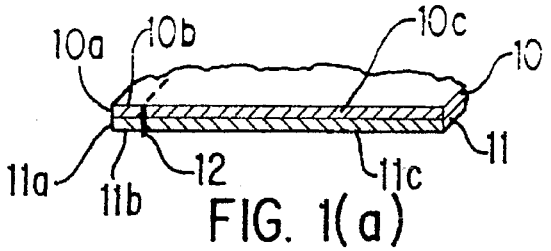
FIGS. 1(*a*) to 1(*c*) are explanatory perspective section views for showing a basic procedure of the method for sewing two stretchable cloths of the invention.
Figure 1B:
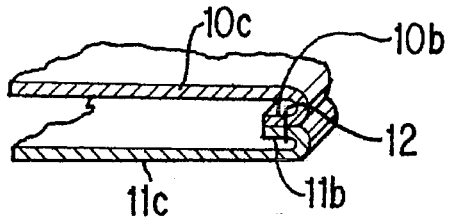
Figure 1C:
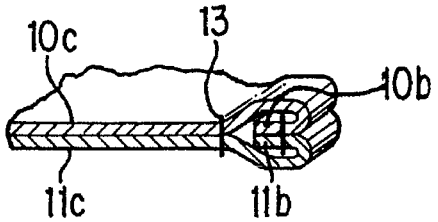

FIGS. 1(*a*)–1(*c*) show a basic method for sewing stretchable cloths 10, 11. At first, the cloths 10, 11 are laminated together such that surfaces, which become inner surfaces when sewing of the cloths 10, 11 is completed, orient outwardly. Then, a first stitch 12 is applied along edges 10*a*, 11*a* of the cloths 10, 11, as shown in FIG. 1(*a*). Free ends 10*b*, 11*b* are formed between the first stitch 12 and the edge 10*a*, and between the first stitch 12 and the edge 11*a*. Main portions 10*c*, 11*c* are formed inside the first stitch 12.

It is desirable that the distance from the first stitch 12 to the edges 10*a*, 11*a* is constant. Even if the distance changes, however, it is still possible to use the method of the invention, though a holding stitch explained later may not be formed so beautifully.

Then, the main portions 10*c*, 11*c* are turned inside out such that the free ends 10*b*, 11*b* are sandwiched between the main portions 10*c*, 11*c*, as shown in FIG. 1(*b*). The surfaces oriented outwardly in FIG. 1(*a*) face each other.

Thereafter, the holding stitch 13 is applied to connect the main portions 10*c*, 11*c* together outside the free ends 10*b*, 11*b*, as shown in FIG. 1(*c*). In the invention, the holding stitch 13 must be formed outside the free ends 10*b*, 11*b*. Also, when the holding stitch 13 is formed, the free ends 10*b*, 11*b* are pushed outwardly to stretch or apply tension to the cloths 10, 11.

In particular, when the holding stitch 13 is formed, a sewing machine (not shown) for the holding stitch 13 is provided with a holding plate for sewing a zipper, i.e. zipper foot. Since the width of the holding plate for the zipper is relatively thin, when the holding stitch 13 is formed by the sewing machine with the holding plate or the zipper foot, the holding plate can push the free ends 10*b*, 11*b* laterally and outwardly. Therefore, it is possible to form the holding stitch 13 while lateral tension toward the free ends 10*b*, 11*b* is applied to the cloths 10, 11. Accordingly, the cloths 10, 11 do not extend in the sewing direction too much, so that the holding stitch 13 can be formed easily and beautifully.

Since the edges 10*a*, 11*a* of the free ends 10*b*, 11*b* indirectly abut against the side portion of the holding plate of the sewing machine, if the distances or widths of the free ends 10*b*, 11*b* changes, tension applied to the cloths 10, 11 changes as well. Thus, the holding stitch 13 may not be formed along a desired stitching line. Even if the distance changes, however, the holding stitch 13 can be formed. In the invention, it is desirable to form the distances or widths for the free ends 10*b*, 11*b* constant.

If the holding stitch is formed above the free ends 10*b*, 11*b*, the stitching portion becomes too thick. Thus, when the stitching is made, the stitched portion expands laterally, so that the desired straight or curved stitch can not be obtained. In the invention, the holding stitch 13 is formed without overlapping the free ends and while the tension is applied to the cloths 10, 11. Therefore, the desired holding stitch 13 can be formed.

Figure 2:
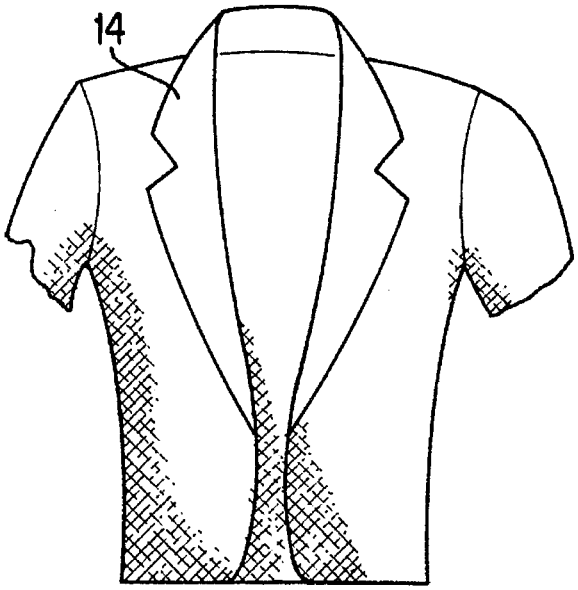
FIG. 2 shows a front view of a garment formed in accordance with the invention.

FIG. 2 shows a front view of a garment formed in accordance with the present invention. The garment is made of stretchable cloths and includes a collar portion 14, where two stretchable cloths are laminated together.

FIGS. 3(*a*)–3(*d*) show steps of sewing a part of the collar portion 14, e.g. left side portion with a dent and projections in FIG. 2. Since FIGS. 3(*a*)–3(*d*) are plan views, one of the cloths is only shown in the drawings.

At first, two cloths are cut to a shape slightly larger than the shape of the collar portion 14, which has two projections 14*a*, 14*b* and a dent 14*c*. A back patch 15 formed of a non-stretchable cloth is placed inside the dent 14*c* for shaping. Then, a first stitch 16 is applied to connect the cloths together along an outer shape of the collar portion 14 when the collar portion 14 is completed, as shown in FIG. 3(*a*) which is a similar condition shown in FIG. 1(*a*). The back patch 15 is sewed by the first stitch 16.

Since the collar portion 14 has the projections 14*a*, 14*b* and the dent 14*c*, free ends of the cloths outside the first stitch 16 are partly cut near the tips of the projections 14*a*, 14*b* and the dent 14*c*. The cut portions are indicated by numeral 17, and do not extend to the first stitch 16, as shown in FIG. 3(*b*).

The cloths are then turned inside out, which is shown in FIG. 3(*c*). This condition is similar to FIG. 1(*b*). The cut portions 17 are formed so that inside portions at the projections 14*a*, 14*b* and the dent 14*c* do not partly overlap or become thick when the cloths are turned inside out. Then, while the free ends are pushed laterally outwardly by the holding plate of the sewing machine as explained before, second or holding stitch 18 is applied to the cloths. This condition is similar to that shown in FIG. 1(*c*). The holding stitch 18 is not formed on the free ends. In FIG. 3(*c*), chain line 19 indicates an edge of the free end situated between the two cloths.

The collar portion 14 may be completed in the condition shown in FIG. 3(*c*). However, additional stitch 20 may be formed at a portion between the holding stitch 18 and an edge of the collar, as shown in FIG. 3(*d*). The stitch 20 completely penetrate the free ends. In this respect, since the holding stitch 18 is formed first, the stitch 20 can be formed to penetrate the free ends. The stitch 20 can not be formed earlier than the stitch 18.

In the embodiment, since the back patch 15 is formed at the dent portion 14*c*, the shape of the dent portion is properly kept when the collar is completed. The back patch may be formed at the projections 14*a*, 14*b*. Also, in the embodiment, since the cut portions 17 are formed in the free ends, the projections and the dent can keep the shapes without becoming too thick.

FIGS. 4(*a*) and 4(*b*) show a further modified embodiment for sewing a stretchable cloth 21 with a stretchable end tape 22. Namely, the stretchable end tape 22 is placed over the stretchable cloth 21 such that an outer surface of the end tape 22 faces an outer surface of the cloth 21, and is sewed together to form a first stitch 23 along an edge of the cloth 21, as shown in FIG. 4(*a*). This step is similar to the step shown in FIG. 1(*a*), but the first stitch 23 is an interlock stitch including an edge finish by a zigzag stitch and regular stitch for sewing two cloths. The edge finish and the regular stitch may be applied separately.

Thereafter, the end tape 22 is turned to dispose the end tape 22 under the cloth 21. Thus, free ends 21*a*, 22*a* are covered by the end tape 22. Then, a holding stitch 24 is applied to connect the cloth 21 and the tape 22 together while the free end 22*a* is pushing laterally, as shown in FIG. 4(*b*). As explained before, since the free end 22*a* is pushed laterally when the holding stitch 24 is formed, the holding stitch 24 can be formed beautifully as desired.

In the embodiment, since the end tape 22 having the same stretchability as that of the cloth 21 can be attached to an end of the cloth 21 or garment around a neck or sleeve portion, it is possible to provide the same stretchability around the neck or sleeve portion as in the other portions. Therefore, the garment can retain substantially the same stretchability in all the portions.

In the present invention, the cloths stretchable in all the directions can be stitched together beautifully without difficulty.

While the invention has been explained with reference to the specific embodiments, the explanation is illustrative and the invention is limited only by the appended claims.

What is claimed is:

1. A method of sewing two stretchable cloths, comprising:

laminating two stretchable cloths so that first surfaces of the stretchable cloths orient outwardly while second surfaces of the stretchable cloths face inwardly, each stretchable cloth having an outer edge, a first sewing line situated away form the outer edge to thereby form a free end between the outer edge and the first sewing line, and a main portion, said stretchable cloths having at least one of projections and dents, sewing said two stretchable cloths along the first sewing lines to form an outer stitch, said outer stitch being formed along said at least one of the projections and the dents, cutting the free ends near tips of said at least one of the projections and the dents to reduce thickness of the free ends when the stretchable cloths are turned, turning at least one of the two stretchable cloths so that the first surfaces face each other and the second surfaces orient outwardly, said free ends of the stretchable cloths being covered by at least one of the main portions, and sewing the stretchable cloths along a second sewing line outside the free ends while a tension is applied from the second sewing line to the free ends for stretching the cloths to thereby form a holding stitch.

2. A method of sewing two stretchable cloths according to claim 1, wherein a non-stretchable back patch is plied over the two stretchable cloths at said at least one of the projections and the dents, said outer stitch and holding stitch being applied over the back patch to retain a shape of said at least one of the projections and the dents.

3. A method of sewing two stretchable cloths according to claim 1, wherein said two stretchable cloths are turned to cover the free ends by the turned stretchable cloths.

4. A method of sewing two stretchable cloths according to claim 1, wherein said outer stitch is an interlock stitching formed of a zigzag stitch portion for covering the outer edges of the cloths, and a straight stitch portion for sewing the cloths together.

5. A method of sewing two stretchable cloths, comprising:

laminating two stretchable cloths so that first surfaces of the stretchable cloths orient outwardly while second surfaces of the stretchable cloths face inwardly, each stretchable cloth having an outer edge, a first sewing line situated away form the outer edge to thereby form a free end between the outer edge and the first sewing line, and a main portion, sewing said two stretchable cloths along the first sewing lines to form an outer stitch, turning at least one of the two stretchable cloths so that the first surfaces face inwardly and the second surfaces orient outwardly, said free ends of the stretchable cloths being covered by at least one of the main portions, sewing the stretchable cloths along a second sewing line outside the free ends while a tension is applied from the second sewing line to the free ends for stretching the cloths to thereby form a holding stitch, and sewing the stretchable cloths at the free ends.

6. A method of sewing two stretchable cloths, comprising:

laminating two stretchable cloths so that first surfaces of the stretchable cloths orient outwardly while second surfaces of the stretchable cloths face inwardly, each stretchable cloth having an outer edge, a first sewing line situated away form the outer edge to thereby form a free end between the outer edge and the first sewing line, and a main portion, sewing said two stretchable cloths along the first sewing lines to form an interlock stitching, said interlock stitch having a zigzag stitch portion for covering the outer edges of the cloths and a straight stitch portion for connecting the cloths along the first sewing lines, turning at least one of the two stretchable cloths so that the first surfaces face inwardly and the second surfaces orient outwardly, said free ends of the stretchable cloths being covered by at least one of the main portions, and sewing the stretchable cloths along a second sewing line outside the free ends while a tension is applied from the second sewing line to the free ends for stretching the cloths to thereby form a holding stitch so that when the stretchable cloths sewed together are pulled, the stretchable cloths can stretch along the holding stitch.

7. A method of sewing two stretchable cloths according to claim 6, wherein one of the stretchable cloths is an end tape, said end tape being only turned to cover the free ends.

8. A method of sewing two stretchable cloths according to claim 6, wherein said stretchable cloth expands in all directions.

* * * * *